US006142852A

United States Patent [19]

Lerolle-Lelorrain et al.

[11] Patent Number: 6,142,852

[45] Date of Patent: Nov. 7, 2000

[54] BRASSIERE COMPRISING AT LEAST ONE ELASTIFIED CUP

[76] Inventors: Denise Lerolle-Lelorrain, 6, Place Winston Churchill, F-92200 Neuilly-sur-Seine, France; Tae H. Kim, 5342 Paoli Cir., Bloomington, Minn. 55437; Daniel H. Dunn, 210 Westwood Dr. South, Golden Valley, Minn. 55416; Joanne Elizabeth Birnberg, 2441 Cedar La., Minneapolis; Risa Asmus-Dorweiler, 30 Lawn Ter., Golden Valley, both of Minn. 55416

[21] Appl. No.: 09/219,929

[22] Filed: Dec. 23, 1998

[51] Int. Cl.[7] ..... A41C 3/00

[52] U.S. Cl. ..... 450/65; 450/66; 450/68; 450/75

[58] Field of Search ..... 450/65, 66, 67, 450/68, 75, 76, 70, 74, 60, 1, 7, 8, 19–21

[56] References Cited

U.S. PATENT DOCUMENTS

| | | | |
|---|---|---|---|
| 2,486,836 | 11/1949 | Garson | 450/1 |
| 2,966,785 | 1/1961 | Goff et al. | 450/68 |
| 4,767,377 | 8/1988 | Falla | 450/65 |
| 4,909,771 | 3/1990 | Bergman | 450/70 X |
| 5,873,767 | 2/1999 | Pickett | 450/1 |

*Primary Examiner*—Gloria M. Hale
*Attorney, Agent, or Firm*—Smith Gambrell & Russell, LLP

[57] ABSTRACT

A brassiere includes a support portion (straps, sides, back, etc.) for supporting the brassiere on the human body, and two cups joined to the support portion. At least one of the two cups includes an additional elastic portion that is adapted to exercise an elastic retention effect on an oedema of the breast held in the cup. This additional elastic cup portion, which is preferably placed on the exterior of the cup, is adapted to have, in a slacked or unstretched state, a surface area smaller than the cup and a depth smaller than the cup. The additional elastic cup portion is attached solely along its periphery to the periphery of the cup.

5 Claims, 1 Drawing Sheet

BRASSIERE COMPRISING AT LEAST ONE ELASTIFIED CUP

BACKGROUND OF THE INVENTION

The present invention relates to a brassiere comprising a support portion (straps, sides, back, etc.) supporting the brassiere on the human body, and two cups joined to the support portion.

Current known brassieres, whether elastic or non-elastic, do not give satisfactory performance following a traumatic procedure, such as treatment of breast cancer by surgery and radiation, or lymph node surgery, leading to the formation of oedema. In effect, as with all oedemas, in order to be reabsorbed, an oedema of the breast must undergo an elastic compression or retention treatment. Such an elastic compression is not feasible, under satisfactory conditions, with the help of known brassieres, whether elastic or non-elastic.

Non-elastic brassieres, made, for example, from cotton, do not by definition allow an elastic retention effect to be exercised.

Elastic brassieres, of whatever nature, currently contain synthetic fibers. Thus, direct contact with the skin is generally not withstood, taking into account the extreme sensitivity of the skin due to the trauma resulting from treatment by surgery and radiation. Moreover, these brassieres, because they are entirely elastic, do not allow a controlled elastic retention on the affected breast alone.

BRIEF DESCRIPTION OF THE INVENTION

The object of the present invention is to provide a brassiere conceived so as to enable the exercise of an elastic compression effect without presenting the inconveniences of known brassieres.

The brassiere according to the invention comprises a support portion (straps, sides, back, etc.) supporting the brassiere on the human body, and two cups joined to the support portion. At least one of the two cups includes an additional elastic cup portion adapted to exercise an elastic compression effect on an oedema of the breast contained in the cup.

Due to the provision of the additional elastic cup portion, it is possible to manufacture the brassiere in its entirety (support portion and cups), except for the additional elastic cup portion, from non-elastic textile material, preferably cotton, in the manner of a classic brassiere of this type, the elastic effect being exercised solely by the additional elastic cup portion.

By preference, the additional elastic cup portion is adapted to have, in a slacked (unstretched) state, a surface area smaller than the corresponding cup. The additional elastic cup portion is joined solely along its periphery to the periphery of the cup.

The additional elastic cup portion may advantageously have, in a slacked state, a depth smaller than the cup.

According to a particularly preferred embodiment, the additional elastic cup portion is placed on the exterior of the cup.

BRIEF DESCRIPTION OF THE DRAWINGS

Referring to the attached drawings, a detailed description of two embodiments of the invention will follow. In the drawings.

DETAILED DESCRIPTION OF THE INVENTION

Figure 1:
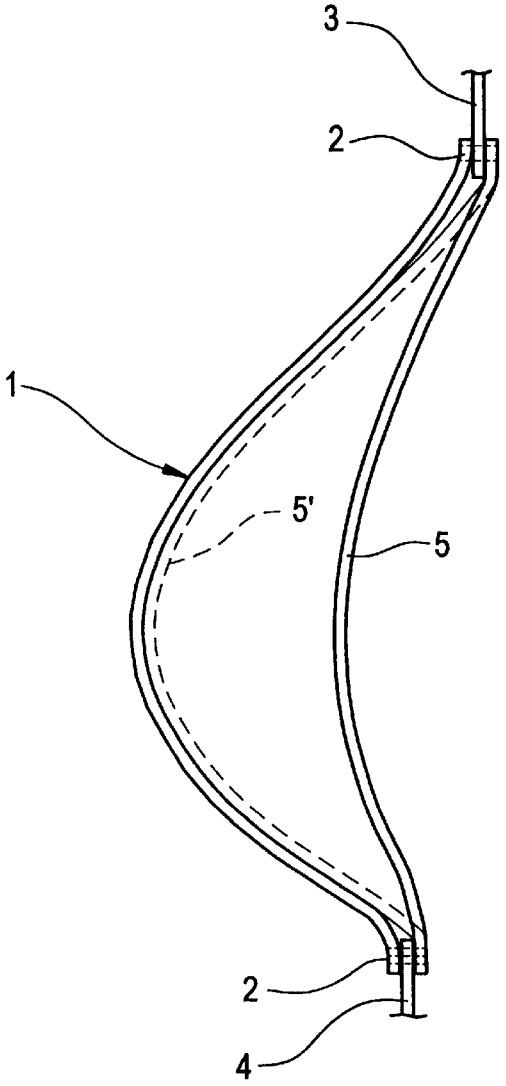
FIG. 1 is a schematic sectional view of a brassiere cup with an interior additional elastic cup portion.

According to FIG. 1, a cup 1 made from a non-elastic textile material as a part of a brassiere (preferably of a non-underwired type) is joined all along its periphery by stitches 2 to a support portion, which is symbolized by a strap 3 and a band underneath 4, but also comprises side and back parts. The support portion 3, 4 is also made of non-elastic textile material.

The cup 1 is fitted with an additional cup portion 5 of elastic textile material, attached along its periphery to the support portion 3, 4 by the same stitches 2 as the cup 1. The additional elastic cup portion 5 is adapted to present, in a slacked state, as indicated by solid lines, a surface area smaller than the cup 1, and a depth smaller than the cup 1.

As indicated by broken lines 5' on FIG. 1, the additional elastic cup portion 5 can undergo a maximal elastic deformation to take the form of the cup 1, exercising between the two extreme positions (as represented by solid lines 5 and by broken lines 5') an elastic effect of compression or retention of the breast, in order to assist and accelerate the re-absorption of an oedema following, for example, surgery and/or radiation procedures on a breast affected with cancer.

The elastic textile fibers currently available are generally synthetic fibers, and direct contact with the skin is in principle not tolerated following such a procedure. For that reason, the embodiment of FIG. 1 is given only for illustrative title. Its use is not in principle foreseeable unless elastic textile fibers become available which can be placed in direct contact with the skin, even if the skin becomes sensitive following a treatment.

Figure 2:
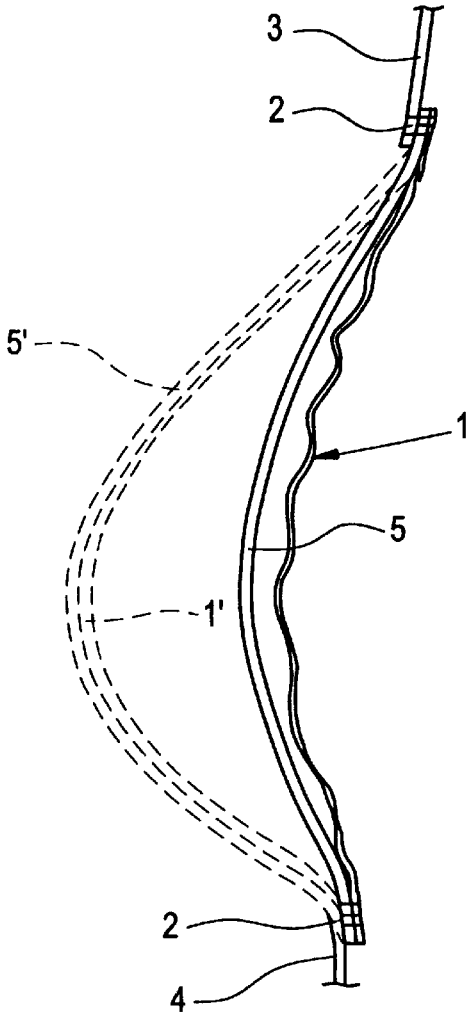
FIG. 2 is a corresponding sectional view of a brassiere cup with an exterior additional elastic cup portion.

FIG. 2 illustrates a preferred embodiment of the invention, relating to a brassiere with a support portion 3, 4 and cups made from non-elastic textile material, preferably cotton, one cup 1 being fitted with an external additional elastic cup portion 5. The additional elastic cup portion 5 here also presents, in a slacked state, a surface area smaller than the cup 1. The cup 1 is show crumpled in a slacked state by solid lines, owing to the presence of the additional elastic cup portion 5.

As shown in broken lines (5') in FIG. 2, the additional elastic cup portion is capable of elastically deforming from a slacked state to take the form of the maximally taut cup (1'), exercising on the breast held in the cup 1, between the two extreme positions (5, 5'), an elastic effect of retention as in the example of FIG. 1. Conversely, as the cup 1, made of cotton or a similar textile material, is placed between the breast and the additional elastic cup portion 5, the additional elastic cup portion 5 does not enter into contact with the skin and can without problem be manufactured from synthetic elastic fibers known in the textile domain.

We claim:

1. A brassiere comprising:

a support portion for supporting the brassiere on a human body, wherein said support portion is made from a non-elastic textile material;

a first cup having a periphery, a surface area, and a depth, said first cup being joined along its periphery to said support portion, wherein said first cup is made from a non-elastic textile material;

a second cup having a periphery, a surface area, and a depth, said second cup being joined along its periphery to said support portion, wherein said second cup is made from a non-elastic textile material; and at least one additional cup portion made from an elastic material, said additional cup portion having a periphery, a surface area, and a depth, wherein said additional cup portion is joined along its periphery to the periphery of said first cup, and wherein said surface area and said depth of said additional cup portion, in an unstretched state, is smaller than the surface area and depth of said first cup, whereby said additional cup portion exercises an elastic retention effect on an oedema of a breast held in said first cup.

2. A brassiere according to claim 1, wherein said first cup has an exterior and an interior, and wherein said additional cup portion is placed on the exterior of said first cup.

3. A brassiere according to claim 1, wherein said support portion includes straps.

4. A brassiere according to claim 1, wherein said non-elastic textile material of the support portion is cotton.

5. A brassiere according to claim 1, wherein said non-elastic textile material of the first cup and the second cup is cotton.

* * * * *